US008874383B2

(12) United States Patent
Gambier et al.

(10) Patent No.: US 8,874,383 B2
(45) Date of Patent: Oct. 28, 2014

(54) PUMP ASSEMBLY

(75) Inventors: Philippe Gambier, La Defense (FR); Rod Shampine, Houston, TX (US); Joe Hubenschmidt, Sugar Land, TX (US); Rajesh Luharuka, Stafford, TX (US); Hubertus V. Thomeer, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 572 days.

(21) Appl. No.: 12/873,773

(22) Filed: Sep. 1, 2010

(65) Prior Publication Data

US 2011/0052423 A1 Mar. 3, 2011

Related U.S. Application Data

(60) Provisional application No. 61/239,625, filed on Sep. 3, 2009.

(51) Int. Cl.

| | |
|---|---|
| ***G06F 19/00*** | (2011.01) |
| ***G01B 3/44*** | (2006.01) |
| ***G01B 3/52*** | (2006.01) |
| ***F04B 49/00*** | (2006.01) |
| ***F04B 49/06*** | (2006.01) |
| ***F04B 51/00*** | (2006.01) |
| ***F04B 53/22*** | (2006.01) |

(52) U.S. Cl.

CPC ..... *F04B 53/22* (2013.01); *F04B 49/065* (2013.01); *F04B 51/00* (2013.01)

USPC ..... 702/34; 340/572.1; 417/12; 417/22; 417/44.1; 604/66

(58) Field of Classification Search

CPC ... G06Q 10/06; F04D 15/0209; F04B 49/065; F04B 51/00; F04B 53/22

USPC ..... 702/34, 45, 47, 50, 62, 116, 122, 180, 702/183; 340/572.1; 417/12, 22, 44.2; 604/66

See application file for complete search history.

(56) References Cited

U.S. PATENT DOCUMENTS

| | | | | |
|---|---|---|---|---|
| 4,326,837 | A * | 4/1982 | Gilson et al. | 417/12 |
| 7,195,149 | B2 | 3/2007 | Baker et al. | |
| 7,259,675 | B2 * | 8/2007 | Baker et al. | 340/572.1 |
| 7,328,837 | B2 | 2/2008 | Baker et al. | |
| 7,901,190 | B2 * | 3/2011 | Gray | 417/22 |
| 8,337,166 | B2 * | 12/2012 | Meza et al. | 417/44.2 |
| 2009/0209904 | A1 * | 8/2009 | Peeters | 604/66 |

OTHER PUBLICATIONS

Kenneth J. Korane, "Predicting the Life of Hydraulic Hose," Machine Design.com, p. 53(Jul. 8, 2010).

Ruhanen, Antti et al., Sensor-enabled RFID Tag Handbook, Building Radio Frequency IDentification for the GlobalEnvironment, European Commission Contract No. IST-2005-03346 (2007).

* cited by examiner

*Primary Examiner* — John H Le

(74) *Attorney, Agent, or Firm* — Rachel E. Greene; Tim Curington

(57) ABSTRACT

A pump assembly and maintenance system and method. An inventory of pump components has an identifier to track the pump component and a sensor to gather operating data associated with the pump component. A population of pumps is assembled from the pump components. The operating data are correlated with the pump components based on the identifiers in a network-accessible database. The pump components can include interchangeable pump body modules that are separately tracked, whereby the pumps can be repaired by removing and replacing the interchangeable pump body modules.

10 Claims, 9 Drawing Sheets

PUMP ASSEMBLY

CROSS REFERENCE TO RELATED APPLICATION(S)

This application claims the benefit of and priority to provisional application U.S. 61/239,625, filed Sep. 3, 2009.

STATEMENT REGARDING FEDERALLY SPONSORED RESEARCH OR DEVELOPMENT

Not applicable

THE NAMES OF PARTIES TO A JOINT RESEARCH AGREEMENT

Not applicable

INCORPORATION BY REFERENCE OF MATERIAL SUBMITTED ON A COMPACT DISC

Not applicable

BACKGROUND OF THE INVENTION (1) Field of the Invention

The invention is related in general to wellsite surface equipment such as fracturing pumps and the like.

(2) Description of Related Art Including Information Disclosed Under 37 CFR 1.97 and 1.98

Multiplex reciprocating pumps are generally used to pump high pressure fracturing fluids downhole. Typically, the pumps that are used for this purpose have plunger sizes varying from about 9.5 cm (3.75 in.) to about 16.5 cm (6.5 in.) in diameter. These pumps typically have two sections: (a) a power end, the motor assembly that drives the pump plungers (the driveline and transmission are parts of the power end); and (b) a fluid end, the pump container that holds and discharges pressurized fluid.

In triplex pumps, the fluid end has three fluid cylinders. For the purpose of this document, the middle of these three cylinders is referred to as the central cylinder, and the remaining two cylinders are referred to as side cylinders. Similarly, a quintuplex pump has five fluid cylinders, including a middle cylinder and four side cylinders. A fluid end may comprise a single block having cylinders bored therein, known in the art as a monoblock fluid end.

The pumping cycle of the fluid end is composed of two stages: (a) a suction cycle: During this part of the cycle a piston moves outward in a packing bore, thereby lowering the fluid pressure in the fluid end. As the fluid pressure becomes lower than the pressure of the fluid in a suction pipe (typically 2-3 times the atmospheric pressure, approximately 0.28 MPa (40 psi)), the suction valve opens and the fluid end is filled with pumping fluid; and (b) a discharge cycle: During this cycle, the plunger moves forward in the packing bore, thereby progressively increasing the fluid pressure in the pump and closing the suction valve. At a fluid pressure slightly higher than the line pressure (which can range from as low as 13.8 MPa (2 Ksi) to as high as 145 MPa (21 Ksi)) the discharge valve opens, and the high pressure fluid flows through the discharge pipe.

The power end typically includes an engine such as a diesel or gasoline engine, a transmission and a driveline that provides the motive force to reciprocate the pump plungers via rods which are known in the art as pony rods. Often the power ends and fluid ends from different manufacturers are incompatible due to the misalignment of the pony rods and plungers, as well as different profiles and bolting patterns of the attachment flange of the power end relative to the connection block on the fluid end. Power ends may be produced by various manufacturers with considerable variability in the design and/or dimensions of the attachment flange, pony rods, driveline, etc., both between manufacturers as well as between different models from the same manufacturer.

Given a pumping frequency of 2 Hz, i.e., 2 pressure cycles per second, the fluid end body can experience a very large number of stress cycles within a relatively short operational lifespan. These stress cycles, together with the high operating pressures, the difficult nature of the fluids being pumped, and often extreme environmental conditions, gives rise to high maintenance requirements both on the fluid end as well as the power end.

Frequently it is desired to remove power end and/or fluid end pump assembly components from a working pump and replace them with components from inventory to keep the pump assembly in operation while the removed component can be repaired and returned to inventory; however, there are substantial differences between different pump assembly makes and models such that a relatively large inventory is required to provide suitable replacement power ends and/or fluid ends for every type an enterprise may have in operation. A power end from one manufacturer, for example, may not have the proper orientation of drive rods and tie rods to the fluid end of another manufacturer, or the appropriate stroke length. Standardization of fluid ends and pump ends for one manufacturer can lead to sourcing and pricing issues and for these reasons it is advantageous to have a wide range of suppliers for the various pump components.

Complicating matters further, the pump components may be selected for use at random without regard to the history of the pump components. The wrong components may be used if there is no system in place to confirm that the component is the proper one for the particular pump assembly, e.g., that a certain component such as a plunger, fluid end or the like is compatible with the other pump components. Further, even where the correct components are used, the use of older components with little remaining life, although appearing robust from inspection, can lead to premature or unexpected failure of the pump assembly, requiring the pump to be taken out of service while the failed component is repaired or replaced.

It remains desirable to provide improvements in wellsite surface equipment in efficiency, flexibility, reliability, and maintainability.

BRIEF SUMMARY OF THE INVENTION

The present invention relates to identifiers that can be used to track the history of pump components, which can be used to allow for efficient allocation of resources and minimization of excess pump ad pump component inventories. The operating history of the pump components in one embodiment can be tracked using sensors to gather operating data for the pump components, which are then correlated with the identifiers in a network accessible database. The operating history data can be used, in one embodiment, to determine maintenance requirements and/or estimate the remaining life of the component so it can be serviced at appropriate intervals and retired from service prior to failure. The sensors can be for temperature, pressure, fatigue damage accumulation or the like, and in one embodiment can be integrated with the identifiers, for example, in sensor-enabled RF ID tags embedded in or attached to the pump components. The database can also be populated with maintenance and other service events associated with the identifier, by automatic uploading or user input via an interface device, e.g., a portable RF ID tag reader.

In an embodiment, a pump assembly and maintenance system, comprises: an inventory of pump components having an identifier to track the pump component and a sensor to gather operating data associated with the pump component; a population of pumps assembled from the pump components; and a network-accessible database wherein the operating data are correlated with the pump components based on the identifiers. In an embodiment, the pump components comprise a prime mover, a transmission, a drive line and a fluid end. In an embodiment, the pump components comprise interchangeable pump body modules, whereby the pumps can be repaired by removing and replacing the interchangeable pump body modules.

In another embodiment a method comprises: (1) providing an inventory of pump components having an identifier to track the pump component and a sensor to gather operating data associated with the pump component; (2) assembling pumps from the pump components; (3) placing a plurality of the pump assemblies in service; (4) uploading the operating data to a network accessible database, wherein the operating data are correlated with the pump components based on the identifiers; and (5) planning maintenance of the pump components based on an operating history of the pump components according to the database.

In an embodiment, the pump components comprise interchangeable pump body modules, and the method includes removing one or more of the interchangeable pump body modules from a pump for repair or maintenance and replacing it with another one or more interchangeable pump body modules from the inventory.

In another embodiment, a pump component tracking and diagnostic system comprises: a pump comprising a sensor to generate a signal responsive to a physical parameter from a pump component, wherein the pump component is associated with an identifier; a controller to acquire the component identifier and pump component information based on the signal from the sensor for transfer to a computer network; and a pump database accessible from the network to provide access to the pump component information based on the component identification. In an embodiment, the pump component comprises an interchangeable pump body module, wherein the pump is assembled from a plurality of the pump body modules.

In embodiments, the sensor is embedded in the pump body module or can be attached externally. If desired, a wireless tag is encoded with the identifier and integrated with the sensor. In embodiments, the physical parameter of the sensor comprises temperature, pressure, acceleration, inclination, humidity, light, density, viscosity, flow rate, chemical composition, deformation, positron decay, acoustic emission, Barkhausen noise, accumulated fatigue damage, and so on or a combination thereof.

In an embodiment, the system can further comprise a user interface to upload additional pump component information to the database. In embodiments, the pump component information in the database comprises at least one of operating pressure, operating temperature, number of cycles of operation, operating time, flow rate, throughput, fatigue accumulation, maintenance history. In an embodiment, the system can further comprise a network accessible planning module to allocate and plan for maintenance of the component, wherein the module comprises a model to estimate remaining life of the component based on the pump component information, and optionally, an alarm module coupled to the planning module to provide an operator alert for pump component maintenance.

In another embodiment, a pump component tracking and diagnostic system comprises: a population of pumps assembled from a plurality of interchangeable pump bodies, wherein the pump assembly comprises an RF ID tag encoded with an identifier and attached to a pump body, and a sensor integrated with or linked to the RF ID tag to provide operating data for the pump body; an RF ID tag reader to acquire the identifier and operating data for transfer to a computer network; a network-accessible pump database providing access to the pump body information based on the identifier; and a module to plan for maintenance of the pump bodies based on the operating data.

In an embodiment, the RF ID tag reader comprises a user interface to upload to the database pump component information inputted by the user. In an embodiment, the operating data comprise at least one of operating pressure, operating temperature, number of cycles of operation, operating time, flow rate, throughput, fatigue accumulation, maintenance history.

In an embodiment, the planning module comprises a model to estimate remaining life of the component based on the pump component information. In an embodiment, an alarm module is coupled to the planning module to provide an operator alert for pump component maintenance.

In another embodiment, a pump assembly comprises: at least one pump body comprising a piston bore, an inlet bore, an outlet bore and a unique identifier; a sensor attached to the pump body to generate signal data responsive to a physical parameter from the pump body, wherein the sensor comprises one or more for temperature, pressure, acceleration, inclination, humidity, light, density, viscosity, flow rate, chemical composition, strain, deformation, positron decay, acoustic emission, Barkhausen noise, accumulated fatigue damage or a combination thereof; and a communications link to upload the identifier and the signal data.

In an embodiment, the pump assembly comprises a plurality of the pump bodies secured in a line with fasteners between opposite end plates. In a further embodiment, each pump body comprises raised surfaces on opposite exterior side surfaces of the pump bodies, wherein the raised surfaces engage with an adjacent end plate or the raised surface of an adjacent pump body, whereby tightening of the fasteners applies a pre-compressive force at the raised surfaces on each of the pump bodies, wherein the sensor is optionally located in or adjacent at least one of the raised surfaces.

In an alternate embodiment, each pump body comprises an expanded displacement plug in a cavity to apply a pre-compressive force at the cavity on each of the pump bodies, wherein the sensor is optionally located in or adjacent the expanded displacement plug.

In yet another embodiment, a pump assembly comprises: a pump body comprising a piston bore, an inlet bore and an outlet bore; an RF ID tag encoded with an identifier and attached to a pump body; a sensor integrated with or linked to the RF ID tag to provide operating data for the pump body, wherein the sensor comprises one or more for temperature, pressure, acceleration, inclination, humidity, light, density, viscosity, flow rate, chemical composition, strain, deformation, positron decay, acoustic emission, Barkhausen noise, accumulated fatigue damage or a combination thereof; a sensor attached to the pump body to obtain pump operating information, wherein the sensor is selected from the group consisting of temperature sensors, pressure sensors, strain gauges, accumulated fatigue damage sensors, and combinations thereof; and an RF ID tag encoded with an identifier and in communication with the sensor to wirelessly transmit the pump operating information to a remote receiver.

In an embodiment, the pump assembly comprises a plurality of the pump bodies secured in a line with fasteners between opposite end plates. In this embodiment, each pump body can further comprise raised surfaces on opposite exterior side surfaces of the pump bodies, wherein the raised surfaces engage with an adjacent end plate or the raised surface of an adjacent pump body, whereby tightening of the fasteners applies a pre-compressive force at the raised surfaces on each of the pump bodies. If desired, the RF ID tag can be located in or adjacent at least one of the raised surfaces. In an alternate or additional embodiment, each pump body can comprise an expanded displacement plug in a cavity to apply a pre-compressive force at the cavity on each of the pump bodies, wherein if desired the RF ID tag can be located in or adjacent the expanded displacement plug.

In a further embodiment, a method, comprises: attaching a sensor to a pump body comprising a piston bore, an inlet bore and an outlet bore, wherein the sensor comprises one or more for temperature, pressure, acceleration, inclination, humidity, light, density, viscosity, flow rate, chemical composition, strain, deformation, positron decay, acoustic emission, Barkhausen noise, accumulated fatigue damage or a combination thereof; attaching an RF ID tag encoded with an identifier to the pump body to receive a data signal from the sensor; assembling a multiplex pump from a plurality of the pump bodies; operating the multiplex pump by reciprocating a plunger in the piston bore; uploading operating data from the RF ID tag to a network accessible database wherein the operating data are correlated with the identifiers to build a data history for the pump bodies.

In embodiments, the method can comprise embedding the sensor, the RF ID tag or the combination thereof in the pump body, or attachment thereof externally to the pump body. In an embodiment, the sensor is integrated with the RF ID tag, for example, a sensor-enabled RF ID. In an embodiment, uploading the operating data from the RF ID tag to the database comprises uploading the operating data to an RF ID tag reader, and transferring the data from the tag reader to the database. If desired, a user can input pump component data manually, automatically or semi-automatically, e.g., via the RF ID tag reader.

In an embodiment, the method can comprise estimating remaining life of the pump bodies using a model based on the operating data, and planning maintenance of the pump bodies based on the estimated remaining life. In an embodiment, the method can include sending an alert to a user for maintenance of the pump bodies.

DETAILED DESCRIPTION OF THE INVENTION

Figure 1:
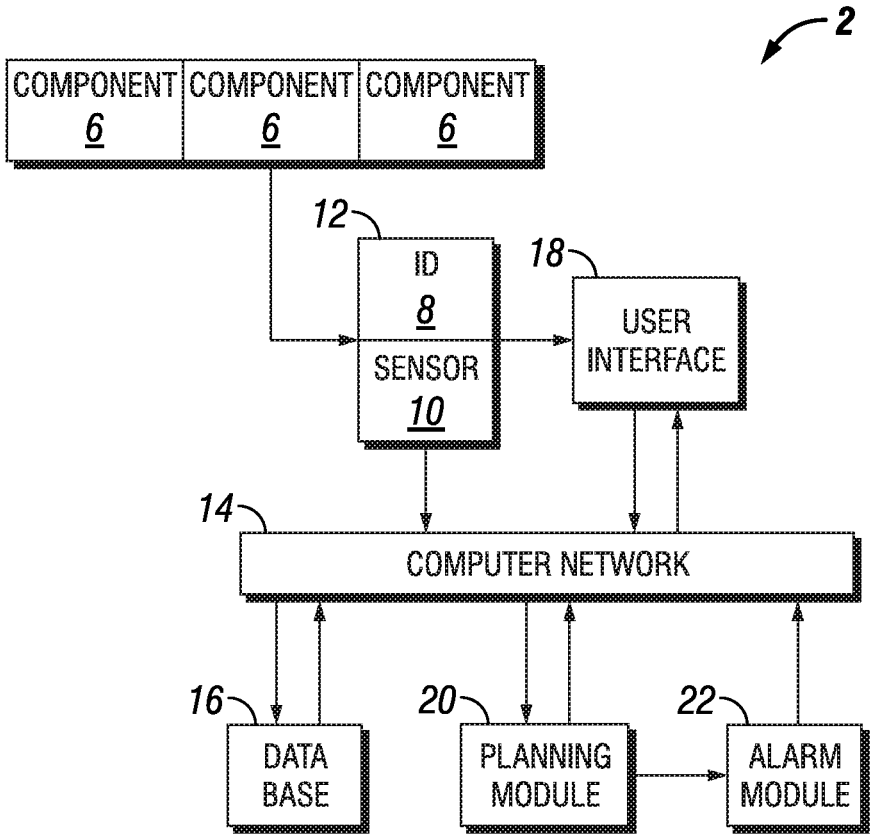
FIG. 1 is a schematic architectural diagram of a pump component tracking and diagnostic system according to an embodiment.

With reference to FIG. 1 tracking system 2 for pumps and pump components according to one embodiment comprises at least one pump assembly 4 made from pump components 6 to be monitored and/or tracked which are provided with an identifier 8 and sensor 10. The pump assembly 4 may comprise a power end, a fluid end, and a power end-fluid end adaptor, as described more fully below, each of which may be separately tracked or monitored. The subassemblies may further comprise pump components which may be separately tracked, e.g., the fluid end assemblies may be made from pump body modules, end plates, plungers, manifolds, etc., and the adaptors from drive rod-plunger clamps, tie rods, and so on.

A variety of markers or identifiers may be used for the identifier 8 such as, but not limited to, an RF ID tag or chip embedded in the component, a series of physical grooves or bumps on the component which may act as a binary indicator for mechanical switches, an ID tag, such as a bar code or magnetic strip, applied to the component 6, an engraving etched directly to a container for the component 6, etc. One or more of these and other identification markers may be used on a variety of components 6. The markers may be, for example, a serial number or other identifier positioned on the component 6. The marker or identifier 8 may be located anywhere on the component 6, such as on the interior or exterior thereof, as described below. The RF ID tag can be passive, semi-passive, or active. Suitable shielding may be utilized for RF ID tags or chips, as will be appreciated by those skilled in the art.

At least one component identifier 8 and/or at least one sensor 10 may be disposed on each of the pump components 6 to be tracked and/or monitored. The sensor 10 may comprise, but is not limited to, any suitable sensor such as a pressure sensor, temperature sensor or the like. In an embodiment, the sensor 10 comprises one or more for temperature, pressure, acceleration, inclination, humidity, light, density, viscosity, flow rate, chemical composition, strain, deformation, positron decay, acoustic emission, Barkhausen noise, accumulated fatigue damage or a combination thereof. The sensor 10 in one embodiment is attached to the pump component 6 to obtain pump operating information, and can be selected from the group consisting of temperature sensors, pressure sensors, strain gauges, accumulated fatigue damage sensors, and combinations thereof.

As temperature sensors, there may be mentioned bipolar transistors, many of which are compatible with standard CMOS technology and can thus be integrated into RF modules. As pressure sensors there may be mentioned microelectromechanical systems (MEMS), piezoresistive sensors, capacitive sensors, resonance sensors, and so on.

The sensor 10 may be disposed within the pump component 6, or subassembly or assembly, such as embedded sensors or the like, or may be disposed on the exterior of the pump component, for gathering information related to operational data of the component to which is attached.

In one embodiment, the sensor 10 may comprise a pressure burst disc or the like disposed within a fluid flow passage in the pump 4 or in fluid communication therewith. The sensor may comprise a fatigue damage accumulating device that may be removed to determine the cumulative fatigue stress and/or failure progression of the component, such as, but not limited to, a burst disc having a measurable fatigue disc, a device wherein positron decay may be measured, a device wherein Barkhausen noise may be measured, a device wherein strain or deformation (such as by compression) over time may be measured, and a device wherein peak pressure may be determined by its mechanical deformation or the like. The sensor 10 in one embodiment may be an integral or replaceable part of the pump component 6 that is designed for a finite lifecycle and may fail or provide some other indication of reaching its lifecycle.

In one embodiment, the identifier 8 and the sensor 10 are integrated in a sensor-enabled RF ID tag 12. Sensor-enabled RF ID tags are well known to those skilled in the art, as described, for example, in Ruhanen, Antti et al., Sensor-enabled RFID Tag Handbook, Building Radio Frequency IDentification for the Global Environment (BRIDGE), European Commission Contract No. IST-2005-03346 (2007), which is hereby incorporated herein by reference in its entirety for all purposes.

Regardless of the type(s) of sensor(s) involved, the data from the sensor 10 is continuously or periodically uploaded via computer network 14 to a network accessible database 16 which correlates the sensor data with the pump component identifier 8. In one embodiment, the sensor 10 may be in communication with a controller or the like that receives and/or stores data from a plurality of the sensors. In one embodiment wherein the sensor data is supplied to and/or collected in the RF ID tag 12, which may be separate and/or remote from the sensor 10 or integral therewith, i.e., in a sensor-enabled RF ID tag, the RF ID tag facilitates uploading of data from the sensor 10 to a computer network 14, e.g., by using an RF ID tag reader which is well known to those skilled in the art.

In an embodiment, the identifiers 8 may comprise smart RF tag technology, which advantageously provide large data storage capacity, local data processing, and the interactive use with RF sensor technology. The smart RF ID tags may allow for backward and future compatibility with various radio frequency (RF) systems and/or technologies. The smart RF ID tags store the information related to the component to which it is attached. Such information may be, but is not limited to, the operating hours of those components and may further be updated with any repair or replacement done on the component. In addition, a link to the database 16 or the like may be created to provide operator alarms and/or alerts via alarm module 22 that maintenance may be required on the component 6. Such an external database 16 may be a global, organization-wide database, as will be appreciated by those skilled in the art.

Data from the RFID tags may be accessed with portable readers, and/or may be linked with key pump parameters that are being tracked manually. The data from the smart RFID tags may be synchronized and/or combined with data from an acquisition system for more components, and may be linked to the database 16 such as an equipment maintenance database. The smart RF tag selected is very powerful as it can process data locally and be associated with a sensor 10, e.g., integrated as a sensor-enabled RF ID tag. Using such a complex smart RF tag may be utilized only for local data storage or may be utilized to acquire and store the information, but process the information locally. Suitable shielding may be utilized for smart RF ID tags or chips, as will be appreciated by those skilled in the art.

In one embodiment the system 2 can also include a user interface 18 which allows the user to input the sensor data manually, or to input additional operating or event data, such as, for example, the identifier information for other pump components 6 in the pump 4, service or maintenance records, operating data from a source in addition to the sensor(s) 10, etc. In one embodiment, operating data from one pump component 6 may be correlated with operating data from another component which is used as part of the same pump 4 or subassembly. For example, the unexpected or premature failure of one pump component may indicate another component in the pump had experienced conditions making failure more likely. Interface 18 may be, for example, an RF ID tag reader, such as a handheld PDA used to periodically download the data stored or otherwise available from the RF ID tag, and transfer the data to the database 16 via a communications link to the network 14.

This sensor data may be uploaded and/or analyzed by the controller or a similar processor, in combination with the identifier data, to determine properties of the components to which the sensors are attached. For example, the system 2 can include a network accessible planning module 20, which, by having access to the database of the various sensors, may use a model to determine the remaining life of the pump component 6, for example, the pump body modules, and allow an operator to allocate and plan for maintenance of the pump components by applying the outputs of the models to predict failure of such components.

Data and/or information that may be utilized in such a model may comprise operating pressure and temperature data for each of the pump body portions, especially maximum temperatures and pressures, the number of strokes or cycles of operation of the pump assembly and/or pump bodies, the duration of operation or pumping time, the instantaneous flow rate through the pump assembly, cumulative throughput, and so on. For example, where the pressure sampling frequency is greater than the pump stroke frequency, the pressure pulses or spikes can be counted to determine the number of cycles the pump body has experienced. By utilizing the data, the model may determine the lifecycle and/or predict the life of the components 6 of the pump 4. The data may be gathered from, as noted above, the sensors 10 and/or identifiers 6, data from a data acquisition system from the pump 4, from manual data entry into the model via the user interface 18, or any suitable data entry and/or acquisition, as will be appreciated by those skilled in the art, in order to predict the life of components 6 of the pump assembly 4.

The database 16 in one embodiment can also include other basic information about each pump component 6 that is tracked by the identifier 8, such as the type and size of component and suitability for use with other types and sizes of components, or in particular pump assemblies or subassemblies, installation notes or information, operating limits, etc.

In particular, a compatibility table may indicate the suitability of using two or more components 6 together in a particular pump assembly configuration, providing a cross-check to avoid assigning, shipping, installing or operating mismatched pump components. For example, the identifier information 8 can be used to ensure that the drive rods employed are compatible with the plungers, the plungers with the fluid end pump body modules, etc.

Figure 2:
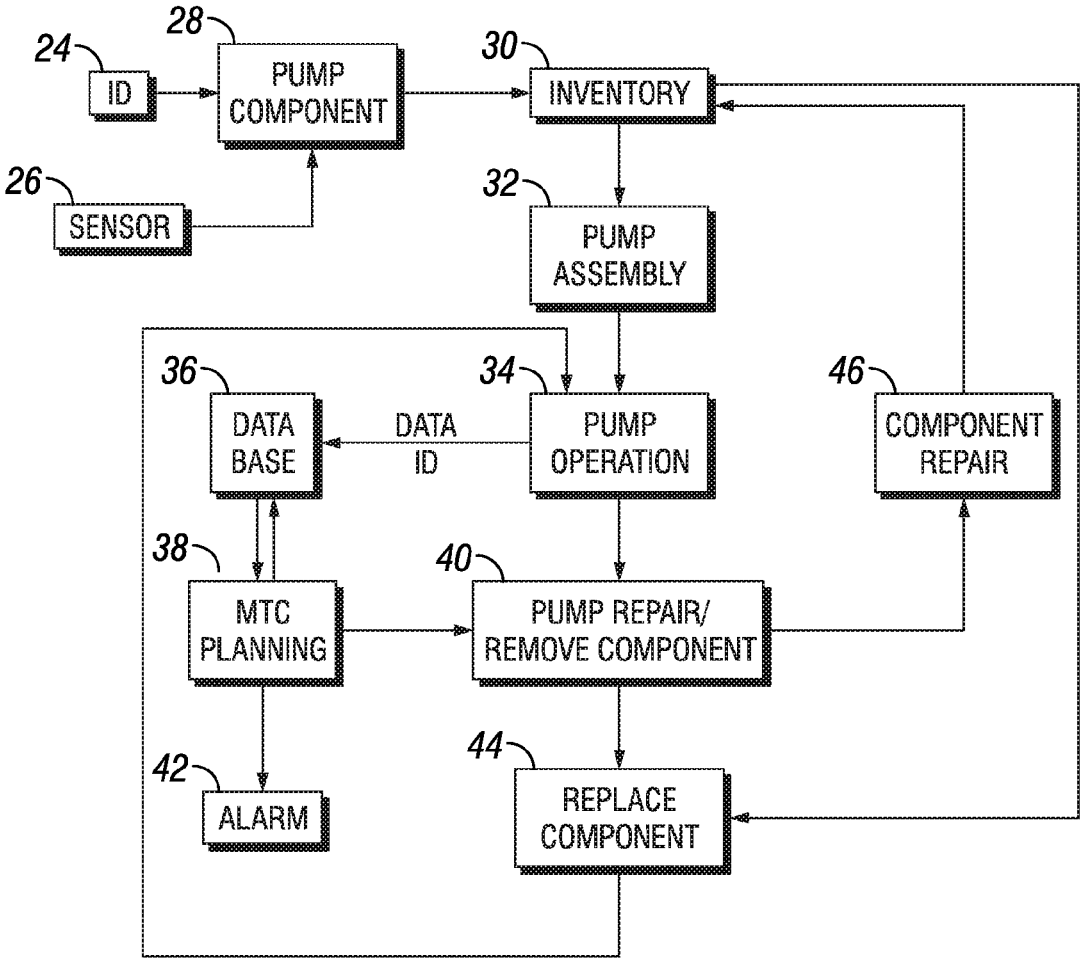
FIG. 2 is a schematic process flow diagram of a method of inventory tracking of pumps and pump components according to an embodiment.

With reference to FIG. 2, another embodiment of the tracking methodology is disclosed. An ID from an identifier selection step 24 and/or a sensor from the sensor selection step 26 are associated with a pump component in the attachment step 28, and the tagged component is processed in an inventory build step 30. The necessary pump components from the inventory building step 30 proceed to pump assembly step 32, and are then placed in service in pump operation 34. In one embodiment, the identifiers on the respective pump components are used to ensure that only compatible components are used to assemble the pump. Pump operating data, including but not limited to the collected sensor data and identifier 8, are uploaded continuously or periodically to database update step 36.

The database is accessed by a maintenance planning step 38, which monitors the data associated with the various pump components in the pump operation 34 based on the identifier. When one or more of the pump components is due for maintenance, the planning step generates a report to trigger pump turnaround 40. If the maintenance planning 38 detects the onset or imminence of failure of a pump component, an alarm or alert event 42 can be generated and the appropriate procedures initiated for resolution of the alert or alarm status.

The pump turnaround 40 can conveniently comprise removing the pump component in need of service, followed by a component replacement event 44 in which the component removed is replaced with a service-ready component from the inventory built in step 30, and the pump is reassembled and promptly returned to operation 34 with minimal down time. In one embodiment, the identifiers on the respective pump components are used to ensure that only compatible components are used as replacement parts. For example, the database can include a compatibility table of matching pump components by identifier label against which new and/or replacement parts can be checked, preferably automatically, to help reduce the risks that mismatched pump components might be used, or that pump components might be used in configurations or applications where their design limits may be exceeded.

If repairable, the pump component from the turnaround step 28 can be repaired in component repair step 46 and returned to inventory build 30, with the repair event appropriately logged into the database updating step 36. Where there is statistically significant information available from the repair event, or from a plurality of similar repair events, the database or the planning module can be appropriately updated, e.g., the available remaining life model might be adjusted and/or the compatibility table updated.

Figure 3:
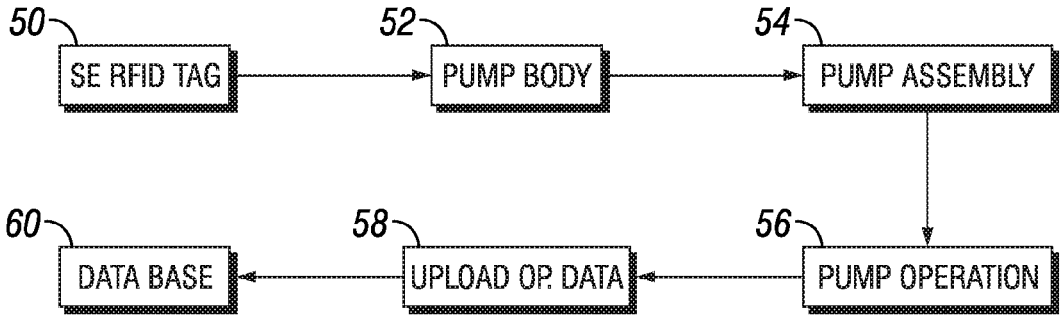
FIG. 3 is a schematic process flow diagram of a pump component tracking system according to an embodiment.

An embodiment employing smart sensor-enabled RF ID tags (SERFID) in pump bodies is illustrated in FIG. 3. The SERFID is selected in step 50 and attached to the pump body module in step 52. The tagged pump body module is then assembled in step 54, typically in a multiplex pump with other tagged pump body modules, and placed in service at step 56. The sensor and ID data are periodically or continuously uploaded in step 58 into database 60.

Figure 4:
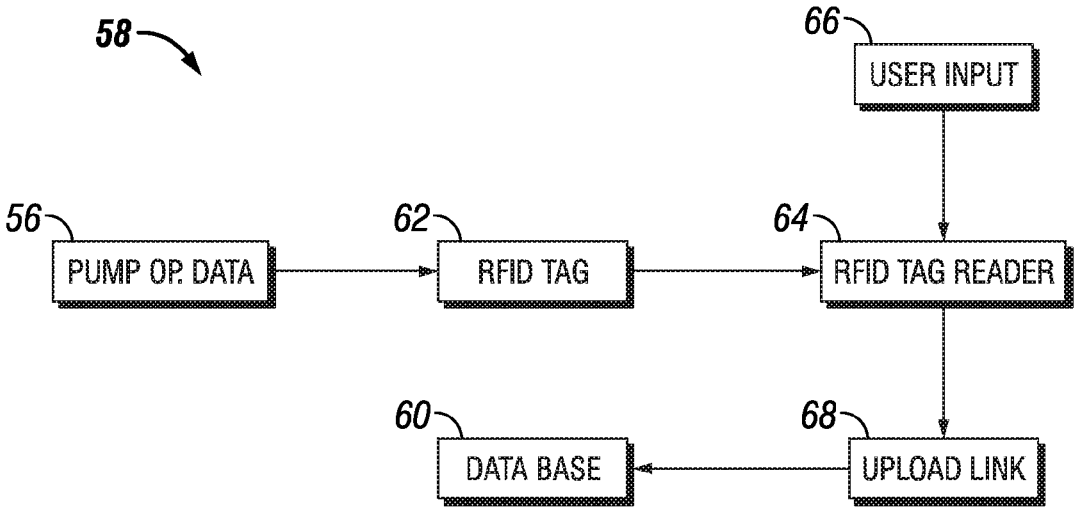
FIG. 4 is a schematic process flow diagram of the data uploading function of FIG. 3 according to an embodiment.
Figure 5:
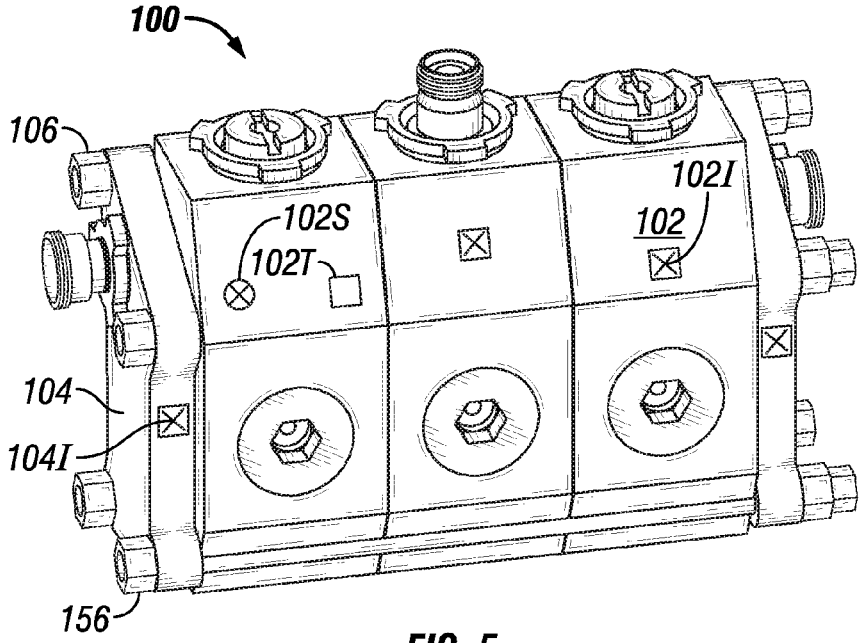
FIG. 5 is a fluid end perspective view of a triplex pump assembly according to an embodiment.
Figure 6:
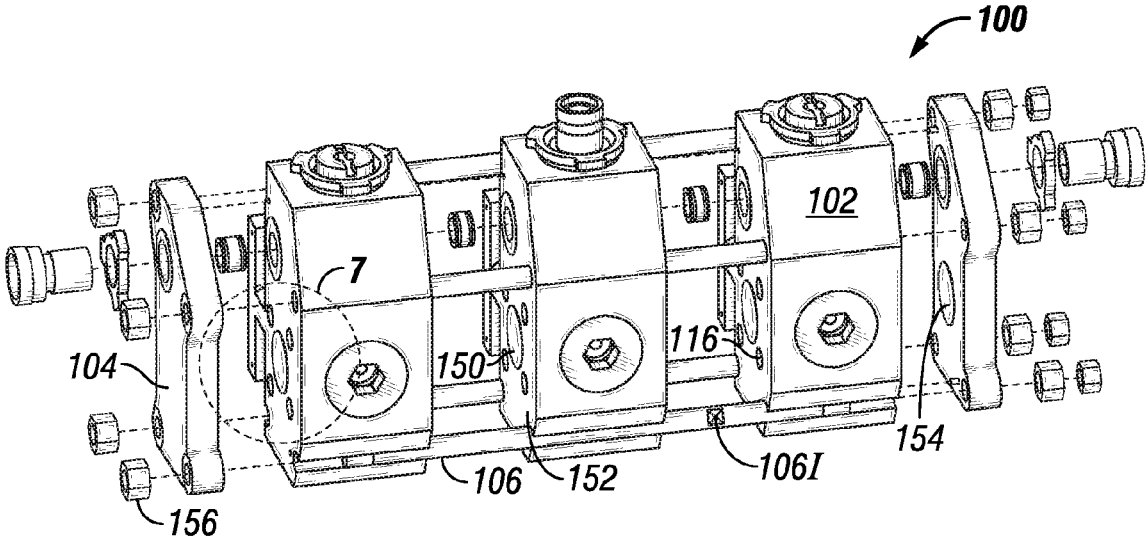
FIG. 6 is exploded view of the triplex pump assembly of FIG. 5 according to an embodiment.

FIG. 4 shows an embodiment of the data uploading step 58 from FIG. 3. The pump operation step 56 generates sensor data which is stored locally in the SERFID tag in a data accumulation step 62. An RFID tag reader is employed to periodically download the data from the tag in the data harvesting step 64. If desired the tag reader can be used to receive additional data at user data input step 66, which can be manual data entry into the reader, for example. The tag reader by means of a suitable communications link to the network then transfers the data in an upload step 68 for database updating step 60.

By placing an identifier, such as an RFID tag on some critical components, an operator may be able to 1) Keep track of each major component during their operation time. 2) Keep track of each major component during their life. 3) Automatically update a database in an accurate, consistent and human interface free way. The identifier allows for the tracking of individual components.

Figure 7:
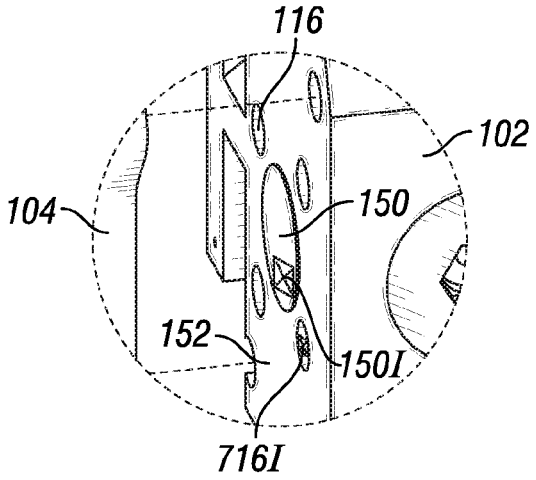
FIG. 7 is a view of the enlargement 7 of FIG. 6 showing a side surface of a pump body according to an embodiment.
Figure 8:
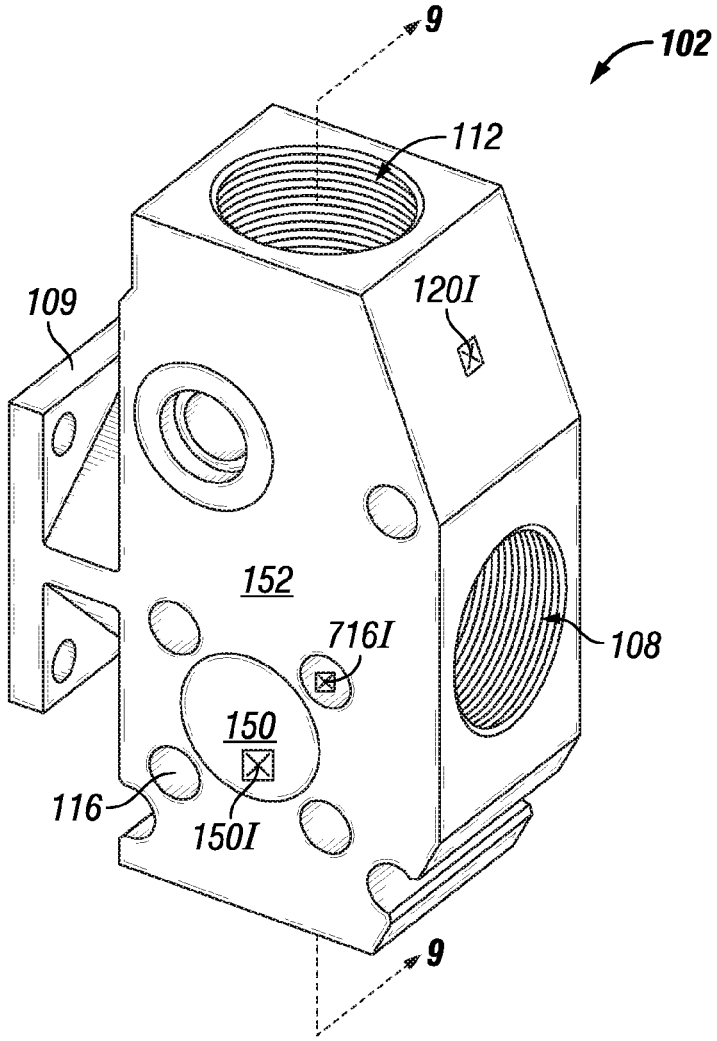
FIG. 8 is a perspective view of one of the pump body portions of the triplex pump assembly of FIGS. 5-7 according to an embodiment.
Figure 9:
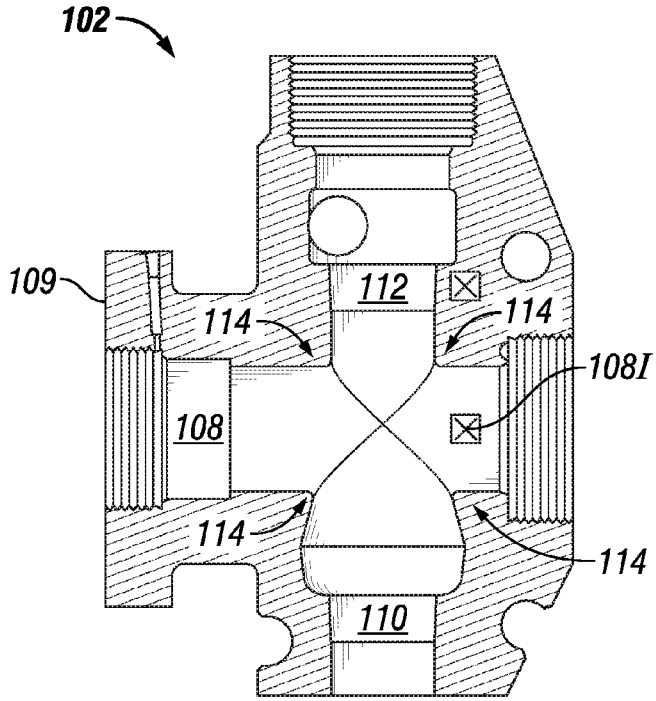
FIG. 9 is a side sectional view of the pump body of FIG. 8 as seen along the lines 9-9 according to an embodiment.

One embodiment of a fluid end assembly 100 suitably used in the present invention is shown in FIGS. 5 to 9, which includes a plurality of pump bodies 102 secured between end plates 104 by means of fasteners 106. The end plates 104 are utilized in conjunction with the fasteners 106 to assemble the pump bodies 102 to form the pump 100. When the pump 100 is assembled, the three pump bodies 102 are assembled together using, for example, four large fasteners or tie rods 106 and the end plates 104 on opposing ends of the pump bodies 102. At least one of the tie rods 106 may extend through the pump bodies 102, while the other of the tie rods 106 may be external of the pump bodies 102. In addition to the triplex configuration of pump 100, those skilled in the art will appreciate that the pump bodies 102 may also be arranged in other configurations, such as a quintuplex pump assembly comprising five pump bodies 102, or the like As best seen in FIGS. 8-9, the pump body 102 has an internal passage or piston bore 108 which may be a through bore for receiving a pump plunger through the fluid end connection block 109. The connection block 109 provides a flange that may extend from the pump body 102 for guiding and attaching a power end to the pistons in the pump 100 and ultimately to a prime mover, such as a diesel engine or the like, as will be appreciated by those skilled in the art. The pump body 102 may further define an inlet port 110 opposite an outlet port 112 substantially perpendicular to the piston bore 108, forming a crossbore. The bores 108, 110, and 112 of the pump body 102 may define substantially similar internal geometry as prior art monoblock fluid ends to provide similar volumetric performance. Those skilled in the art will appreciate that the pump body 100 may comprise bores formed in other configurations such as a T-shape, Y-shape, in-line, or other configurations.

An attachment flange 109 (FIG. 8), may extend from the pump body portion 100 for guiding and attaching a power end to the plungers and ultimately to a prime mover, such as a diesel engine or the like, as will be appreciated by those skilled in the art.

Various of the pump components in the fluid end assembly may be equipped with sensors and/or identifiers according to an embodiment, such as for example, pump body tag 102T, pump body sensor 102S, pump body integrated tag/sensor (SERFID) 102I; end plate SERFID 104I, fastener SERFID 106I, internal bore SERFID 108I (see FIG. 9), flange SERFID 109I, and so on. The tags/sensors can be external to the pump assembly 100 such as, but not limited to components of the transmission, components of the power end, and the plumbing or treating iron that may be connected to the assembly 100 for directing fluid to and from the pump assembly 100.

Due to the substantially identical profiles of the plurality of pump body portions 102, the pump body portions 102 may be advantageously interchanged between the middle and side portions of the assembly 100 and operationally tracked separately from other pump body portions, providing advantages in assembly, disassembly, and maintenance, as will be appreciated by those skilled in the art. In operation, if one of the pump bodies 102 of the assembly 100 fails or is about to fail or is otherwise in need of repair or maintenance, only the particular one of the pump bodies 102 need be removed and replaced, reducing the potential overall downtime of a pump assembly 100 and its associated monetary impact. The pump body portions 102 are smaller than a typical monoblock fluid end having a single body with a plurality of cylinder bores machined therein and therefore provides greater ease of manufacturability due to the reduced size of forging, castings, etc.

The material in the area adjacent the corners or edges 114 at the intersection of the piston bore 108 with the inlet and outlet ports 110, 112 defines areas of stress concentration that may be a concern for material fatigue failure. In addition to the stress concentration, the areas 114 are subject to the operational pressure cycling of the pump, which may further increase the risk of fatigue failure. In an embodiment, the pump bodies 102 may be pre-compressed in order to counteract the potential deformation of the areas 114 by expanding one or more displacement plugs 116 disposed at predetermined locations within the pump body 102. The plugs 116 are placed in, for example, a drilled bore or cavity formed in the body 102 and expanded with the use of an expansion tool and/or application of a radial force to the drilled bore or cavity, as will be appreciated by those skilled in the art. The bore formed in the body 102 may be cylindrical for a cylindrical plug 116, or tapered to accommodate a tapered plug 116 therein.

The expansion of the displacement plug 116 by application of a radial force induces a radial plastic yielding of the plug 116 and an elastic radial deformation of the surrounding material of the pump body 102. When the radial force is removed in one embodiment, the plug 116 contracts slightly radially inward due elastic relaxation, and the stresses in the adjacent areas are re-distributed. The radial deformation of the surrounding material of the pump body 102 does not completely vanish following the relaxation because the elastic radial deformation of the pump body is larger than the plastic radial deformation of the plug 116. As a result, the remaining stresses are re-distributed between the plug 116 and the body 102 after relaxation, generally in the form of compression, although tension is also possible in some regions, especially where there is geometric asymmetry or other anisotropy.

The pre-compressive force in an embodiment may also be hydraulically or pneumatically applied pressure, for example, via suitable sealed hydraulic or pneumatic connections to the cavity. The pre-compressive force in an embodiment may be applied by injecting a liquid or semi-liquid material into the bore that expands as it solidifies, the expansion of the material providing the pre-compressive force. In another embodiment where the plug 116 is permanently expanded or otherwise larger than the cavity in which it is received in the pump body 102, the plug 116 displaces the area around the plug, maintaining stresses against the abutting surface of the cavity.

Determining the location of the bore or cavity for the plug 116, such as by placing the predetermined locations at areas adjacent or near the areas 114, allows for selective control of the stress patterns inside the pump body 102. The pre-compressive force is believed to counteract the potential deformation of the areas 114 due to the operational pressure encountered by the bores 108, 110, 112. By counteracting the potential deformation due to operational pressure, stress on the areas 114 of the pump body 102 is reduced, thereby increasing the overall life of the pump body 102 by reducing the likelihood of fatigue failures.

In one embodiment, a raised surface 150 extends from an exterior surface 152 of the pump modules 102, best seen in FIGS. 7 and 8. In an embodiment, a plurality of the plugs 116 are arranged coaxially around the raised surface 150 at an even spacing. The raised surface 150 may extend a predetermined distance from the exterior surface 152 and may define a predetermined area on the exterior surface 152. While illustrated as circular in shape, the raised surface 150 may be formed in any suitable shape. The end plates 104 may further comprise a raised surface 154, similar to the surface 150 on the pump modules 102 for engaging with the raised surfaces 150 during assembly.

The tie rods or fasteners 106 may be tightened utilizing a hydraulic tensioner, as will be appreciated by those skilled in the art. The tensioner may have its hydraulic power provided by the outlet flow of the pump assembly 100 itself. The hydraulic tensioner may provide a constant tension or a variable tension on the tie rods 106, depending on the requirements of the operation of the assembly 100. As the tie rods 106 are tightened, via threaded nuts 156 or the like, to assemble the fluid end 100, the raised surfaces 150, 154 engage with one another to provide a pre-compressive force to the areas adjacent the intersection of the internal bores. The pre-compressive force may counteract the potential deformation of the areas adjacent the intersection of the internal bores due to the operational pressure. By counteracting the potential deformation due to operational pressure, stress on the adjacent areas is reduced, thereby increasing the overall life of the pump bodies by reducing the likelihood of fatigue failures.

While illustrated as comprising three of the fluid end modules 102, the fluid end assembly 100 may be formed in different configurations, such as by separating or segmenting each of the fluid end modules 102 further, by segmenting each of the fluid end modules 102 in equal halves along an axis that is substantially perpendicular to the surfaces 152, or by any suitable segmentation.

In the foregoing embodiments, the precompressive force elements may be conveniently equipped with embedded or attached tags, sensors, SERFIDs or the like, e.g., plug SERFID 116I, surface SERFID 150I, and so on. The plug SERFID 116I in one embodiment can be disposed in an a small bore or cavity formed in the plug 116. The plug/surface SERFIDs 116I, 150I can be, for example, equipped with a strain gauge sensor to track the ambient compressive forces and monitor for any dissipation or other changes indicative of fatigue damage.

Figure 10:
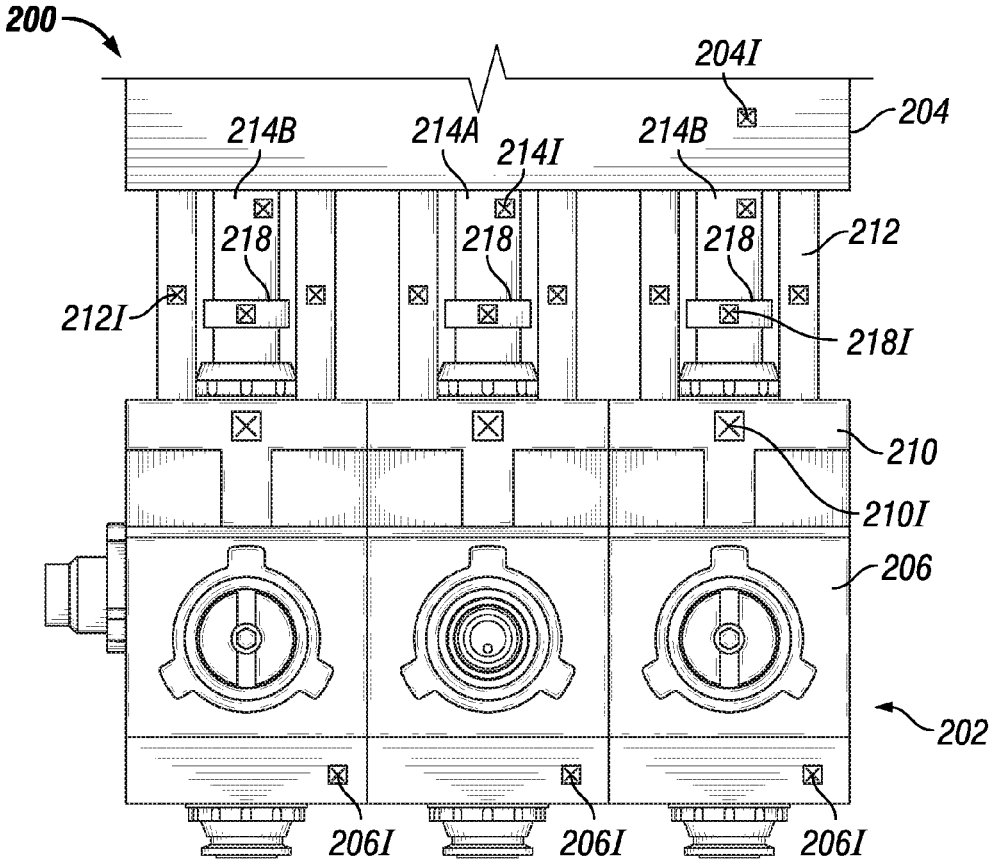
FIG. 10 is a top plan view of a pump assembly according to an embodiment.

FIG. 10 illustrates a pump assembly 200 incorporating a standard triplex fluid end 202 and a standard or offset power end 204, according to one embodiment. The fluid end 202 comprises three interchangeable fluid end modules 206 which have a respective plunger 208 with a standard spacing in a line, and attachment flange 210 with a standard configuration for tie rods 212. The power end 204 has a middle drive rod 214A and side drive rods 214B, as well as a configuration for tie rods 212 that matches the configuration for the fluid end modules 206. The pump assembly 200 can be provided with various tags/sensors, e.g., power end SERFID(s) 204I, fluid end module SERFIDs 206I, plunger SERFID 208I, flange SERFID 210I, tie rod SERFID 212I, drive rod SERFID 214I, clamp SERFID 218I, and so on, which may be internal, structurally embedded and/or attached at a surface of the particular component.

Figure 12:
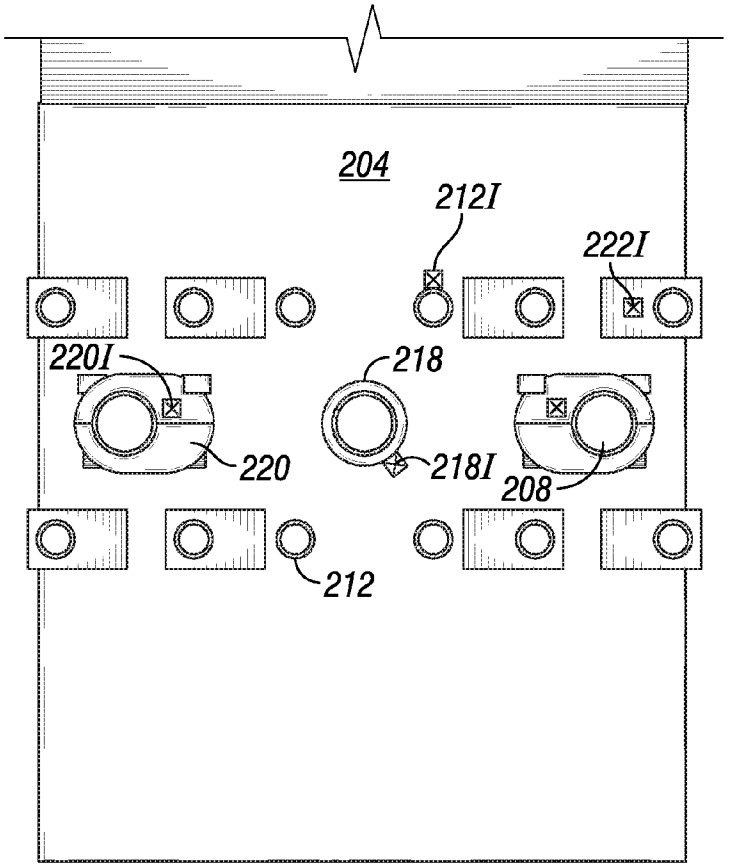
FIG. 12 is a sectional view of the pump assembly of FIG. 11 as seen along the lines 11-11 according to an embodiment.
Figure 11:
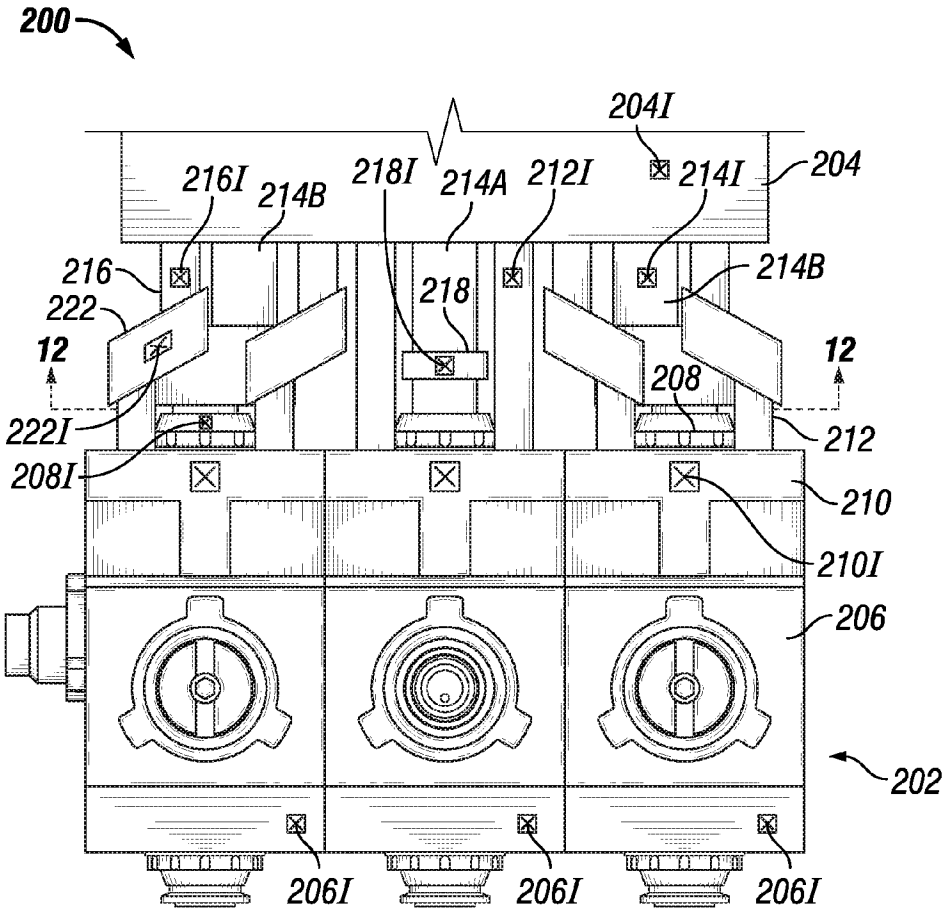
FIG. 11 is a top plan view of an offset pump assembly according to another embodiment.
Figure 13:
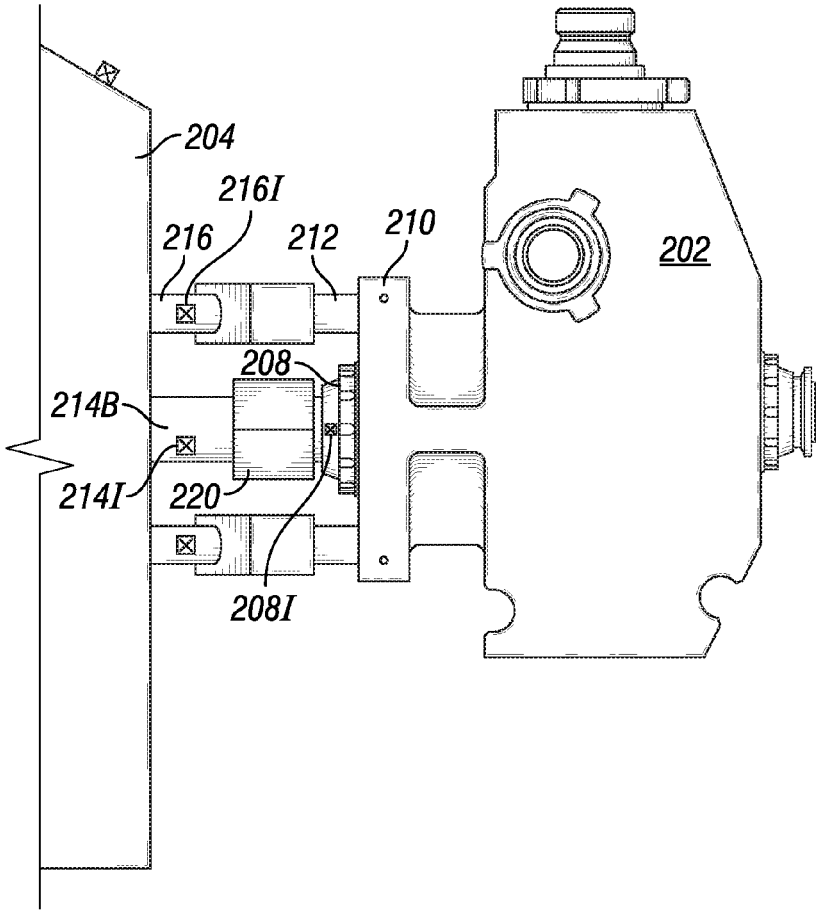
FIG. 13 is a side elevation view of the pump assembly of FIGS. 11-12 according to an embodiment of the invention.

FIGS. 11-13 illustrate a pump assembly 200 incorporating a standard triplex fluid end 202 and a non-standard or offset power end 204, according to one embodiment. The fluid end 202 comprises three interchangeable fluid end modules 206 which have a respective plunger 208 with a standard spacing in a line, and attachment flange 210 with a standard configuration for tie rods 212. The power end 204 has a middle drive rod 214A and side drive rods 214B, as well as a configuration for tie rods 216, that may or may not match the configuration for the fluid end plungers 208 and/or tie rods 212, in whole or in part. The pump assembly 200 can be provided with various tags/sensors, e.g., power end SERFID(s) 204I, fluid end module SERFIDs 206I, plunger SERFID 208I, flange SERFID 210I, tie rod SERFIDs 212I, 216I, drive rod SERFID 214I, clamp SERFIDs 218I, 220I, bolt adaptor SERFIDS 222I, and so on, which may be internal, structurally embedded and/or attached at a surface of the particular component.

An adaptor module in the particular example of this embodiment shown in FIGS. 11-13 includes a standard aligned plunger-drive rod clamp 218 for the middle drive rod 214A and the middle one of the plungers 208, and offset plunger-drive rod clamps 220 to connect the side drive rods 214B to the side ones of the plungers 208. In general, it is preferred to align one of the drive rods 214A, 214B with one of the plungers 208, preferably the middle drive rod 214A, to avoid space issues for the offset clamps 220 where the adjacent drive rods 214, 214B may not provide sufficient room for the use of adjacent offset clamps 220. The combination of the standard clamp 218 and the particular offset clamps 220 may be specific to each type of power end 204, depending on the plunger-drive rod offset distance and direction, and these may be inventoried and/or tracked/monitored separately as components, or alternatively and/or additionally as prepacked kits or packages comprising one, a plurality or all of the clamps 218, 220 required for assembly of a particular combination of power end 204 and fluid end assembly 202.

The adaptor module may also include offset bolt adaptors 222 as required for the offset tie rods 216. In general, the fluid end assembly 202 should have one or more tie rods 212 that align with the tie rod configuration for the offset power end 204, although it is possible that none or all of tie rods 212, 216 will align for which the offset bolt adaptors 222 are not required. As with the plunger clamps 218, 220, the offset bolt adaptors 222 and tie rods 212, 216 of the appropriate number, diameter, thread pitch, length, etc. may be inventoried separately and/or as part of a kit labeled for the particular combination of power end 204 and fluid end assembly 202.

Figure 14:
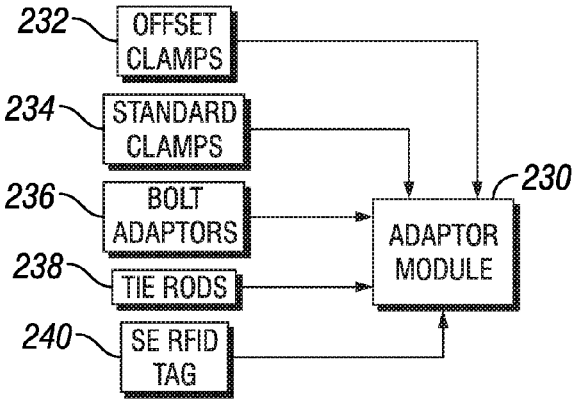
FIG. 14 is a schematic diagram of an adaptor module according to an embodiment.

FIG. 14 illustrates one embodiment of a prepackaged adaptor module 230 which can be populated with the required number and type of offset drive rod-plunger clamps 232, standard clamps 234, bolt adaptors 236, tie rods 238, SERFID tags 240, and so on, for a particular power end-fluid end assembly. The module 230 can be inventoried separately, or additionally or alternatively paired with the appropriate power end. Additionally or alternatively a module 230 can include additional components 232, 234, 236, 238 necessary for connecting a plurality of some or all of the different types of power ends or in different configurations or types of configurations so that the number of adaptor modules kept in inventory is minimized. Additionally the adaptor modules may include spare or extra components 232, 234, 236, 238 for the assembly, and may include any other parts frequently or occasionally used in making a fluid pump assembly. The module 230 may be inventoried, tracked and/or monitored as a single assembly, or alternatively or additionally one or more of the components 232, 234, 236, 238 may be separately inventoried, tracked and/or monitored as desired.

Figure 15:
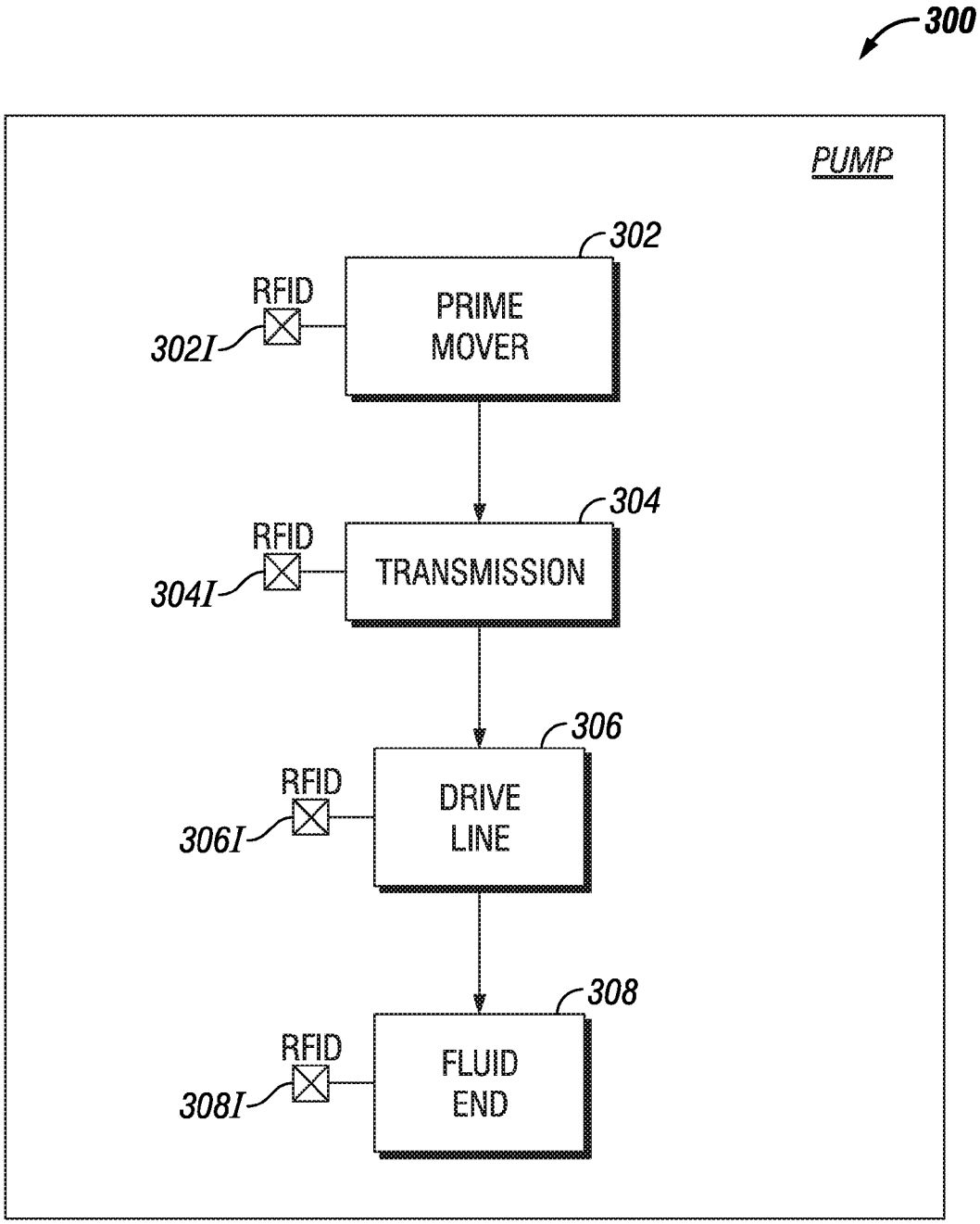
FIG. 15 is a schematic diagram of a pump assembly according to an embodiment.

FIG. 15 shows a pump assembly 300 comprising the subassemblies of a prime mover 302 such as an engine or electric motor, transmission 304, drive line 306 also referred to as a power end, and fluid end 308. The assembly can be mounted on a truck bed or skid for transport to a job site, for example. The assembly 300 is provided with, for example, one or more of an engine RFID 302I, transmission RFID 304I, power end RFID 306I, and fluid end RFID 308I, which may be embedded or externally mounted, and which may be sensor enabled in one embodiment, for tracking the various pump components. The RFIDs 302, 304, 306, 308 may be associated with the respective assemblies, or may be associated with particular component(s) of the assemblies as discussed above.

The preceding description has been presented with reference to present embodiments. Persons skilled in the art and technology to which this disclosure pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

We claim:

1. A pump component tracking and diagnostic system, comprising:

a pump comprising a sensor to generate a signal responsive to a physical parameter from a pump component, wherein the pump component is associated with an identifier, wherein the pump component comprises an interchangeable pump body module, wherein the pump is assembled from a plurality of the pump body modules, and secured with fasteners between opposite end plates;

a controller to acquire the component identifier and pump component information based on the signal from the sensor for transfer to a computer network; and a pump database accessible from the network to provide access to the pump component information based on the component identification.

2. A pump assembly, comprising:

a plurality of pump bodies secured with fasteners between opposite end plates, at least one of the pump bodies comprising a piston bore, an inlet bore, an outlet bore and a unique identifier;

a sensor attached to at least one of the pump bodies to generate signal data responsive to a physical parameter from the pump body, wherein the sensor comprises one or more for temperature, pressure, acceleration, inclination, humidity, light, density, viscosity, flow rate, chemical composition, strain, deformation, positron decay, acoustic emission, Barkhausen noise, accumulated fatigue damage or a combination thereof;

a communications link to upload the identifier and the signal data.

3. The pump assembly of claim 2, wherein each pump body further comprises raised surfaces on opposite exterior side surfaces of the pump bodies, wherein the raised surfaces engage with an adjacent end plate or the raised surface of an adjacent pump body, whereby tightening of the fasteners applies a pre-compressive force at the raised surfaces on each of the pump bodies, wherein the sensor is located in or adjacent at least one of the raised surfaces.

4. The pump assembly of claim 2, wherein each pump body further comprises an expanded displacement plug in a cavity to apply a pre-compressive force at the cavity on each of the pump bodies, wherein the sensor is located in or adjacent the expanded displacement plug.

5. The pump assembly of claim 2, further comprising an RF ID tag encoded with the identifier and attached to at least one of the pump bodies, wherein the sensor is integrated with or linked to the RF ID tag to wirelessly transmit the pump operating information to a remote receiver, wherein the sensor comprises one or more for temperature, pressure, acceleration, inclination, humidity, light, density, viscosity, flow rate, chemical composition, strain, deformation, positron decay, acoustic emission, Barkhausen noise, accumulated fatigue damage or a combination thereof.

6. A method, comprising:

attaching a sensor to a pump body comprising a piston bore, an inlet bore and an outlet bore, wherein the sensor comprises one or more for temperature, pressure, acceleration, inclination, humidity, light, density, viscosity, flow rate, chemical composition, strain, deformation, positron decay, acoustic emission, Barkhausen noise, accumulated fatigue damage or a combination thereof;

attaching an RF ID tag encoded with an identifier to the pump body to receive a data signal from the sensor;

assembling a multiplex pump with the pump body to form a plurality of pump bodies secured with fasteners between opposite end plates;

operating the multiplex pump by reciprocating a plunger in the piston bore;

uploading operating data from the RF ID tag to a network accessible database wherein the operating data comprise at least one of operating pressure, operating temperature, number of cycles of operation, operating time, flow rate, throughput, and fatigue accumulation, wherein the operating data are correlated with the identifiers to build a data history for the pump bodies.

7. The method of claim 6, wherein uploading operating data from the RF ID tag to the database comprises uploading the operating data to an RF ID tag reader, and transferring the data from the tag reader to the database.

8. The method of claim 6, further comprising estimating remaining life of the pump bodies using a model based on the operating data, planning maintenance of the pump bodies based on the estimated remaining life, and sending an alert to a user interface device for maintenance of the pump bodies.

9. The method of claim 6, further comprising:

providing an inventory of pump components comprising a plurality of the pump bodies, wherein the pump components comprise RF ID tags and sensors;

assembling pumps from the pump components;

placing a plurality of the pump assemblies in service; and planning maintenance of the pump components based on the data history of the pump components according to the database.

10. The method of claim 9, wherein the pump bodies comprise interchangeable pump body modules, and further comprising removing one of the interchangeable pump body modules from one of the pumps for repair or maintenance and replacing the removed interchangeable pump body module with another one of the interchangeable pump body modules from the inventory.

* * * * *